US011110618B2

(12) United States Patent
Vermette

(10) Patent No.: US 11,110,618 B2
(45) Date of Patent: Sep. 7, 2021

(54) HAND-HELD SHEARING DEVICE

(71) Applicant: Shane Robert Vermette, San Carlos, CA (US)

(72) Inventor: Shane Robert Vermette, San Carlos, CA (US)

( * ) Notice: Subject to any disclaimer, the term of this patent is extended or adjusted under 35 U.S.C. 154(b) by 0 days.

(21) Appl. No.: 14/589,972

(22) Filed: Jan. 5, 2015

(65) Prior Publication Data

US 2016/0193739 A1 Jul. 7, 2016

(51) Int. Cl.

| | |
|---|---|
| ***B26B 13/28*** | (2006.01) |
| ***B26B 13/20*** | (2006.01) |
| ***B26B 13/06*** | (2006.01) |
| ***B26B 13/14*** | (2006.01) |
| ***B26B 13/12*** | (2006.01) |

(52) U.S. Cl.

CPC ..... *B26B 13/28* (2013.01); *B26B 13/06* (2013.01); *B26B 13/12* (2013.01); *B26B 13/14* (2013.01); *B26B 13/20* (2013.01)

(58) Field of Classification Search

CPC ..... B26B 13/28; B26B 13/06; B26B 13/12; B26B 13/14; B26B 13/20; B26B 13/00

USPC ..... 30/261, 244, 248–252, 254, 256, 257, 30/194, 231, 232

See application file for complete search history.

(56) References Cited

U.S. PATENT DOCUMENTS

| | | | | | |
|---|---|---|---|---|---|
| 25,508 | A * | 9/1859 | Heinisch | B26B 13/20 | 30/266 |
| 760,204 | A * | 5/1904 | Heinisch | B26B 13/20 | 30/341 |
| 869,949 | A * | 11/1907 | Westerdahl | B26B 13/20 | 30/257 |
| 2,354,303 | A * | 7/1944 | Carver | A01G 3/06 | 30/257 |
| 2,760,264 | A * | 8/1956 | Javits | A41G 5/02 | 132/53 |
| 4,333,235 | A * | 6/1982 | Howard | B26B 13/12 | 30/259 |
| 4,507,864 | A * | 4/1985 | Leibowitz | B26B 13/12 | 30/239 |
| 4,635,363 | A * | 1/1987 | Chapin | B26B 13/20 | 30/257 |
| 4,901,440 | A * | 2/1990 | Go | A01G 3/02 | 30/233 |
| 5,153,997 | A * | 10/1992 | Chiavaras | B26B 13/20 | 30/235 |
| 5,279,034 | A * | 1/1994 | Smith | B25B 7/00 | 30/232 |
| 5,469,622 | A * | 11/1995 | Gradoni | B26B 13/22 | 30/114 |

(Continued)

FOREIGN PATENT DOCUMENTS

| | | |
|---|---|---|
| DE | 3503767 | 8/1986 |

*Primary Examiner* — Phong H Nguyen

(74) *Attorney, Agent, or Firm* — The Law Office of Herbert T. Patty

(57) ABSTRACT

A hand-held device includes a first member and a second member coupled together by a pivot point such that each member may rotate independently. The hand-held device further comprises a handle on one side of each member and a protrusion on an opposite side of each member. Further, the hand-held device may include counter-torque extensions which extend from each member such that the counter-torque extensions touch when the device is engaged.

16 Claims, 7 Drawing Sheets

(56) References Cited

U.S. PATENT DOCUMENTS

| | | | | |
|---|---|---|---|---|
| 5,943,779 | A * | 8/1999 | Antonio, Jr. | B26B 13/00 30/248 |
| 6,079,107 | A * | 6/2000 | Horvath | B26B 13/06 30/233.5 |
| 6,249,976 | B1 * | 6/2001 | Osame | B26B 13/04 30/199 |
| D686,477 | S * | 7/2013 | Pookrum | D8/107 |
| 8,726,522 | B2 * | 5/2014 | Lin | B26B 13/00 30/232 |
| D718,592 | S | 12/2014 | Roberts et al. | |
| 2001/0037712 | A1 | 11/2001 | Furuhata et al. | |
| 2006/0137192 | A1 * | 6/2006 | Deter | B23D 29/026 30/248 |
| 2007/0199198 | A1 * | 8/2007 | Hsieh | B23D 29/026 30/232 |
| 2008/0022535 | A1 | 1/2008 | Underhill | |
| 2008/0172887 | A1 * | 7/2008 | Potter | B26B 13/22 30/244 |
| 2010/0293793 | A1 * | 11/2010 | Underhill | B26B 13/12 30/232 |

* cited by examiner 300
101
102
left
right
115
116
117
118
160
110
128
105
106
124
125
126
127
129
130
131
122
123

HAND-HELD SHEARING DEVICE

FIELD

This disclosure pertains to a hand-held shearing device and in particular to an inverted shearing device for various cutting applications.

BACKGROUND

Shearing devices have been around for thousands of years to cut a variety of materials. The most common shearing device, a pair of scissors, consists of a pair of blades linked together by a fulcrum and a pair of handles on an opposite end of the blades. Typically, shearing devices are not designed to allow the blades to engage a medium while keeping the user's hand from interfering with the medium during a cutting action, or if they are so designed, then the user's wrist may not be aligned during the cutting action or the device may not fit into the user's palm to facilitate finger control of the device.

Although there are a few shearing devices that exist which are designed to keep one's wrist aligned during a cutting action, these devices fail to allow a user to hold the device in an overhand manner. Accordingly, a need exists for a shearing device to facilitate overhand handling and to provide efficient shearing generation between the blades during a cutting action. The present disclosure provides solutions for such needs.

SUMMARY

This disclosure pertains to a hand-held shearing device and in particular to an inverted shearing device for various cutting applications. A device consistent with the present disclosure includes a first member and a second member coupled together by a pivot point such that each member may rotate independently. The device further comprises a handle on one side of each member and a protrusion on an opposite side of each member. Further, the device includes counter-torque extensions which extend from each member such that the counter-torque extensions touch when the device is engaged.

BRIEF DESCRIPTION OF THE DRAWINGS

To facilitate understanding, identical reference numerals have been used, where possible, to designate identical elements that are common to the drawings. The drawings are not to scale and the relative dimensions of various elements in the drawings are depicted schematically and not necessarily to scale. The techniques of the present disclosure may readily be understood by considering the following detailed description in conjunction with the accompanying drawings, in which.

DETAILED DESCRIPTION

A detailed description of some embodiments is provided below along with accompanying figures. The detailed description is provided in connection with such embodiments, but is not limited to any particular example. Numerous specific details are set forth in the following description in order to provide a thorough understanding. These details are provided for the purpose of example and the described techniques may be practiced according to the claims without some or all of these specific details. For the purpose of clarity, technical material that is known in the technical fields related to some embodiments has not been described in detail to avoid unnecessarily obscuring the description.

Figure 1:
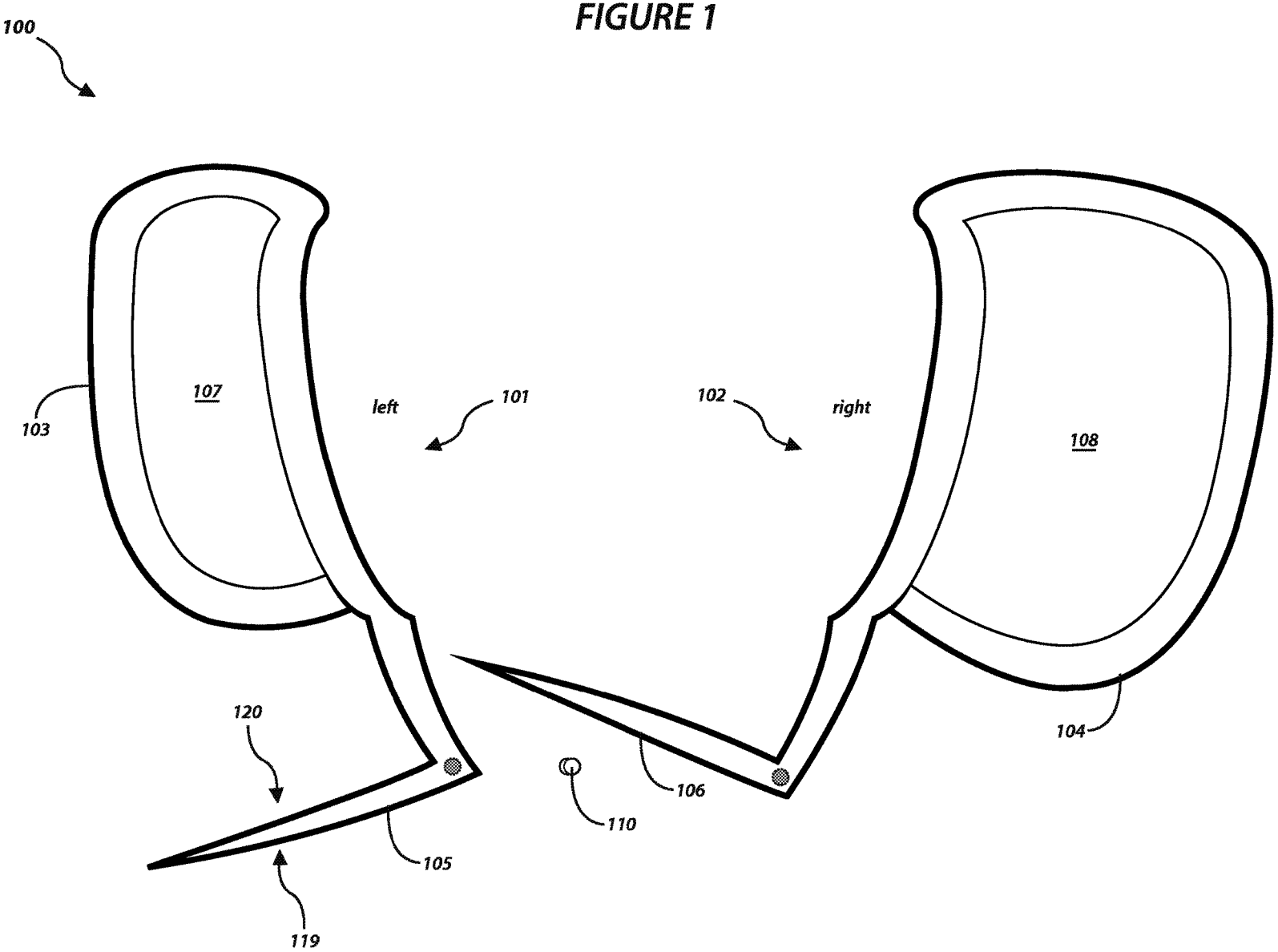
FIG. 1 is an exploded view of a hand-held shearing device consistent with the present disclosure.

FIG. 1 is an exploded view of a hand-held shearing device 100 consistent with the present disclosure. Hand-held shearing device includes a left member 101, right member 102, and pivot member (e.g., fulcrum 110). It should be understood by one having ordinary skill in the art that a hand-held shearing device consistent with the present disclosure may be readily disassembled for such purposes of maintenance, cleaning, sharpening, etcetera. Furthermore, the hand-held shearing device 100 may be designed and fashioned in such a way that it can be disassembled and reassembled without the need of additional tools.

Left member 101 and right member 102 includes a handle on a first region and a protrusion on a second region. As shown, left member 101 includes a handle 103 and a protrusion 105. Likewise, right member 102 includes a handle 104 and a protrusion 106. Notably, handles 103, 104 are disposed above protrusions 105, 106 to facilitate an overhand grip.

An "overhand grip" may be characterized as when a user grips the handles 103, 104, the user's wrist is located above protrusions 105, 106 while the user is handling the hand-held shearing device 100. Further, in response to erecting hand-held shearing device 100 in an upright position, each respective blade 105, 106 is disposed below each corresponding handle to facilitate an overhand grip of the hand-held shearing device 100. Accordingly, the inverted hand-held shearing device 100 disclosed herein facilitates an overhand grip handling of the device 100.

Contrary to conventional shearing devices, when the overhand grip is employed, the user's wrist is located above, and is aligned with, the protrusions of the hand-held shearing device 100. It should be noted that this disclosure does not preclude a user from using the hand-held shearing device 100 in an upside down position ("underhand grip") such that when the user grips the handle, the protrusions are positioned above the wrist.

In some embodiments, handles 103, 104 have an eye-ring shape. In some embodiments, the area 108 of handle 104 exceeds the area 107 of handle 103. Protrusions 105, 106 may be any one of a set of blades, prongs, needles, or the like. In some embodiments, protrusions 105, 106 are blades which feature a dull edge 119 and a cutting edge 120 (e.g., for shearing). In some implementations, protrusions 105, 106 may be blunted or otherwise modified to improve safety or utility.

Fulcrum 110 may couple left member 101 and right member 102 together in a manner such that each member 101, 102 may rotate independently in a clockwise or counterclockwise direction. Fulcrum 110 may be an individual component of hand-held shearing device 100 or may be a component of left or right members 101, 102.

Figure 2:
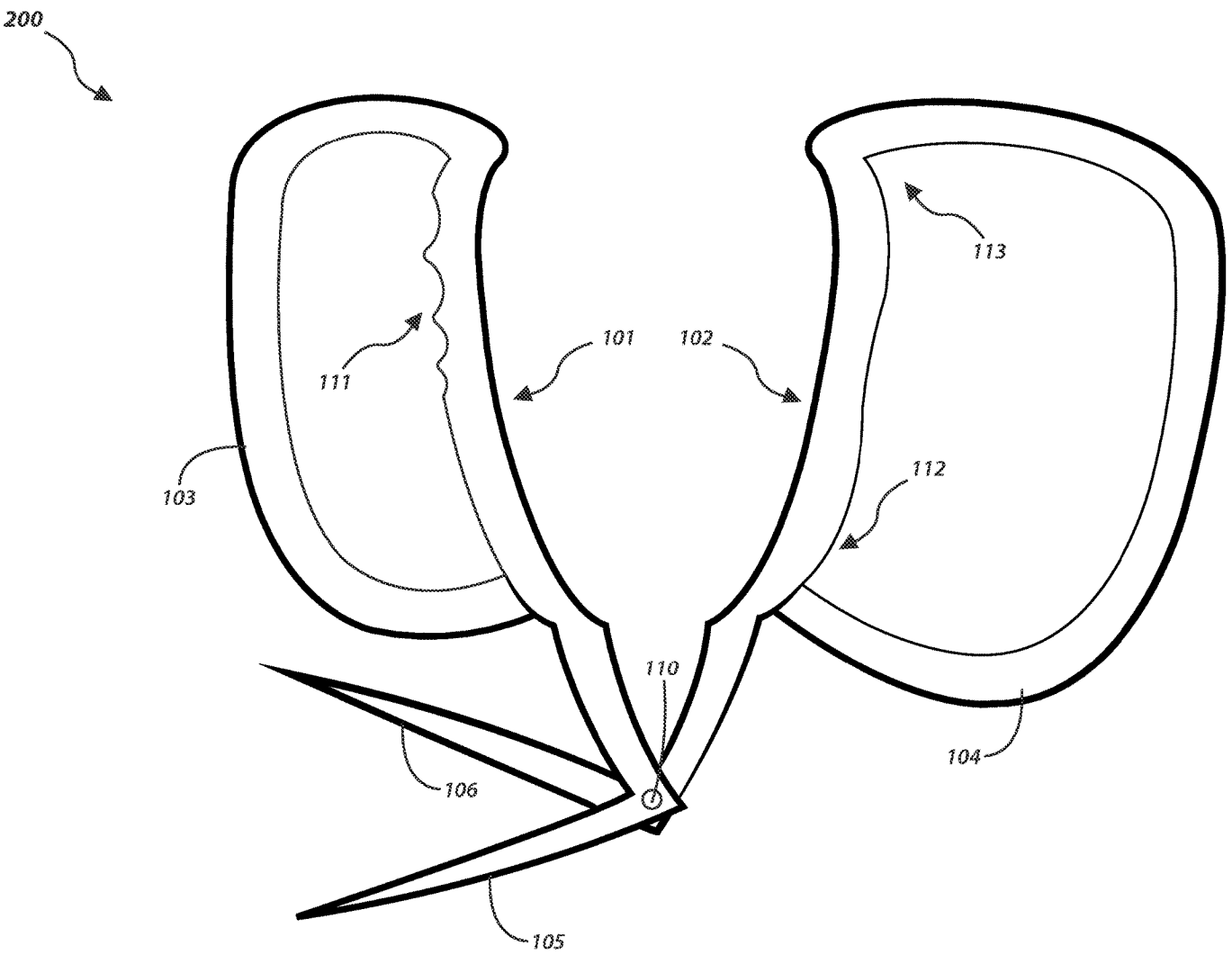
FIG. 2 is a perspective view of a hand-held shearing device consistent with the present disclosure.

FIG. 2 is a perspective view of a hand-held shearing device 200 consistent with the present disclosure. Elements of hand-held shearing device 200 may be incorporated in any of a pair of cutters, clippers, graspers, pliers, or spreaders. As such, a "hand-held shearing device" consistent with the present disclosure is not limited to cutting applications but may be used for various other non-shearing means. In the embodiment shown, the hand-held shearing device 200 is a novel pair of scissors.

In some embodiments, handles 103, 104 of left and right members 101, 102 are disposed approximately at least 75 degrees from blades 105, 106, respectively. However, the present disclosure is not limited thereto. Handles 103, 104 may be disposed from blades 105, 106 an angular distance in the approximate range of 45 to 90 degrees. As such, left and right members 101, 102 are designed to facilitate an overhand grip when the hand-held shearing device 200 is in use. Advantageously, a hand-held shearing device consistent with the present disclosure facilitates a user to keep their wrist aligned while cutting conventional materials as well as materials which do not bend well.

Handles 103, 104 may be shaped to facilitate a sturdy grip to the shearing device 200. For example, handle 103 may have a set of dimensions which allows a user's fingers (i.e., index, middle, ring, and pinky) to be fitted there through to effect a grip with handle 103. For example, an inside portion 111 of handle 103 may include finger grooves. Likewise, handle 104 may have palm heel and thumb supports 112, 113 as shown in the figure.

Accordingly, the features of handles 103, 104 may allow a user to gain maximum leverage thereon to facilitate better control of the hand-held shearing device 200. During operation, a user may push the hand-held shearing device 200 with a user's palm along the cutting path and may direct the device's 200 cutting path with the user's fingers. As such, hand-held shearing device 200 facilitates palm, heel, and finger control while allowing the user to maintain wrist alignment along the cutting path.

In some implementations, the cutting path created by hand-held shearing device 200 need not follow a straight line. For example, blades 105, 106 may be curved, jagged, or otherwise deviate from a straight line to suit various applications. Moreover, blades 105, 106 need not be symmetrical.

Figures 3A, 3B, 3C:
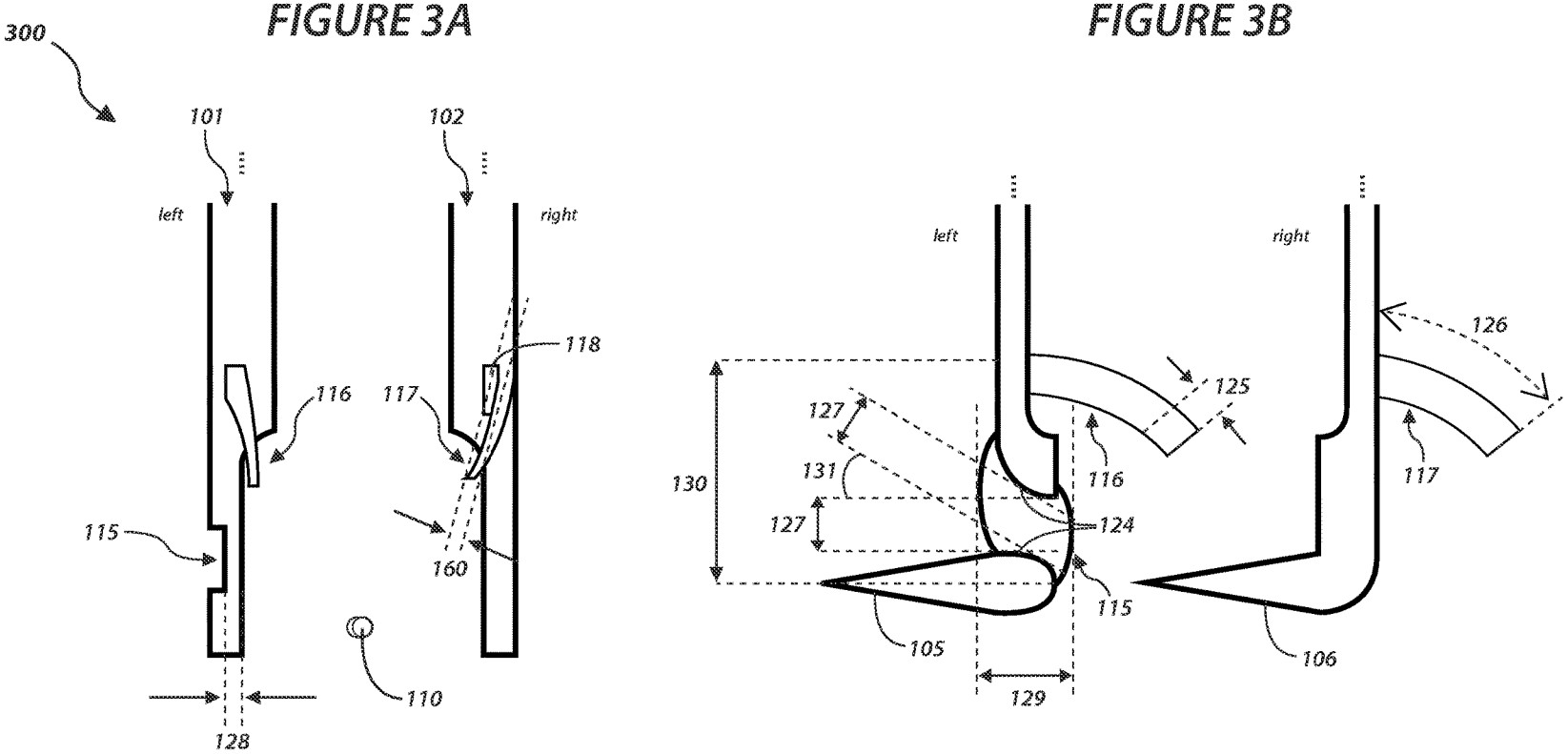
FIGS. 3A-3C illustrate back, side, and bottom views of a hand-held shearing device consistent with the present disclosure.

FIGS. 3A-3C illustrate back, side, and bottom views of a hand-held shearing device 300 consistent with the present disclosure. With respect to FIG. 3A, the back view of left and right members 101, 102 expose the location of fulcrum 110, channel 115, and counter-torque extensions 116, 117. FIG. 3B exposes the contour of the channel 115 and the counter-torque extensions 116, 117.

Referring to FIG. 3A, counter-torque extensions 116, 117, cavity 118, and fulcrum 110 interact together to create a shearing effect with blades 105, 106. Advantageously, the interaction between the counter-torque extensions 116, 117, cavity 118, and fulcrum 110 can produce a counter torque similar to the torque created by a user's fingers with a pair of conventional scissors. Notably, a hand-held shearing device consistent with the present disclosure may be designed to create a counter torque without significant manual manipulation of the left and right members 101, 102.

A portion (i.e., engage length 125) of counter-torque extension 116 traverses at least partially through cavity 118 of right member 102 when the hand-held shearing device 300 begins to close during a cutting action. In some implementations, at least half of counter-torque extension 116 traverses through cavity 118 when the hand-held shearing device 300 begins to close. In other implementations, more or less of counter-torque extension 116 traverses through cavity 118 when the hand-held shearing device 300 begins to close so long as these portions exceed the engage length 125.

In some embodiments, counter-torque extension 116 traverses through cavity 118 an engage length 125 before the counter torque is generated. In some embodiments, the engage length 125 should be maximized such that counter-torque extension 116 traverses as far through cavity 118 before the counter-torque extensions 116, 117 create significant counter-torque. Furthermore, in some implementations, engage length 125 should be as long as possible without hindering the hand-held shearing device's 300 ability to open to a large enough angle to be useful for various shearing applications.

Furthermore, the extension length 126 (e.g., arc length) of counter-torque members 116, 117 should be maximized without hindering (e.g., intersecting) the medium that is being cut. In some embodiments, the extension length 126 of counter-torque extensions 116, 117 may be measured in angular degrees (e.g., at least 45 degrees or greater). In some embodiments, counter-torque extensions 116, 117 are arc-shaped and have the same length. Furthermore, counter-torque extensions 116, 117 may be arcs of the same circle about the fulcrum 110.

In some implementations, as the hand-held shearing device 300 closes, the blades 105, 106 push against each other at the cavity 118, the location at which counter-torque extension 116 traverses at least partially there through. In addition, as the blades 105, 106 close, they also push against each other at the point where counter-torque extensions 116, 117 touch.

In some embodiments, the body of either one or both of counter-torque extensions 116, 117 may have a lateral curvature which may aid in creating counter torque when the shearing device transitions to a closed position. The lateral curvature of the counter-torque extensions 116, 117 may be defined by the maximum distance 160 that the extensions 116, 117 deviate from a straight line in a lateral direction. It should be noted that a lateral curvature is distinguishable from a longitudinal direction in which the counter-torque extensions' 116, 117 "arc-shape" readily exemplifies such curvature.

Referring now to FIG. 3C, counter-torque extensions 116, 117 are angled towards each other such that when hand-held shearing device 300 is engaged in a cutting action, the counter-torque extensions 116, 117 attempt to force fulcrum 110 apart thereby creating the shearing effect between the blades 105, 106.

In addition, during a cutting action, portions of the handles of each member 101, 102 may shear together. Accordingly, the portion of the handles that shear together may be modified (e.g., rounded) to prevent a sharp cutting or pinching intersection while maintaining the shearing effect.

In some embodiments, a channel 115 is disposed on a side of left member 101 which allows a shearable medium being cut to pass freely past the member that extends below the medium (e.g., left member 101). As shown, the portion of left member 101 which makes up the channel 115 may be relatively thin with respect to the remaining portions of left member 101 to reduce the amount that the shearable medium bends as the medium traverses through the channel 115 during a cutting action. In some embodiments, the thickness 128 of channel 115 is thin enough to allow a medium to pass there through but without compromising the flexural strength of the hand-held shearing device 300. The thickness 128 of channel 115 need not be uniform and may be thinner on its leading edge in order to reduce the chance that it binds with the medium during a cutting action.

The top and bottom portions of channel 115 may have a rounded portion 124 to minimize the height and width of the channel 115 needed to retain the hand-held shearing device's 300 flexural strength. Advantageously, the rounded portions 124 of channel 115 allow a shearable medium to traverse along a straight path through channel 115 even when left member 101 is disposed at an angle.

In some embodiments, the height 127 of channel 115 may be minimized to limit the extent to which the flexural strength of hand-held shearing device 300 is affected by channel 115. However, the height 127 of channel 115 should sufficiently accommodate a shearable medium. For example, the height 127 of channel 115 may accommodate paper, a plastic, anti-theft container, metal mesh or sheeting, or a few sheets of cardboard.

In addition, the width 129 of channel 115 may be minimized to aid the turning mobility of the hand-held shearing device 300 within the medium being cut however retaining the flexural strength of the device 300. In some embodiments, the width 129 of channel 115 may be inversely proportional to the thickness 128 of channel 115. The width 129 of channel 115 may also depend on the strength of the material composition of hand-held shearing device 300.

Consistent with prior art devices, hand-held shearing device 300 may be placed in an open or closed position as characterized by the position of each protrusion 105, 106 in relation to each other. In an open state, the tips of protrusions 105, 106 are displaced from each other (e.g., angular distance). The angle at which hand-held shearing device 300 is fully open during use may be referred to as the open angle 131. The open angle 131 of hand-held shearing device 300 may range from 30-75 degrees but the present disclosure is not limited thereto.

Furthermore, the distance (i.e., extension distance 130) between counter-torque extensions 116, 117 and the fulcrum 110 may be optimized such that the extension distance 130 may be minimized to efficiently generate counter torque when counter-torque extensions 116, 117 are engaged. In some implementations, the extent to which extension distance 130 can be minimized is proportional to engage length 125 and extension length 126 of which both should be maximized in these implementations.

FIG. 3C exposes the shape and length of counter-torque extensions 116, 117 from a bottom view. In particular, this figure exposes extension angles 122, 123 of counter-torque extensions 116, 117 as a result of the extensions' 116, 117 lateral displacement. In some implementations, extension angles 122, 123 are functions of the aforementioned dimensions. In some embodiments, counter-torque extension 117 may be non-uniformly convex such that after counter-torque extension 116 traverses through cavity 118 past the engage length 125, additional counter-torque is generated while the hand-held shearing device transitions from an open position to a closed position. As such, various amounts of counter torque at various points of a cutting action may be achieved by varying the extension angles 122, 123 of the counter-torque extensions 116, 117.

It should be noted that the present disclosure is not limited to the bodies of counter-torque extensions 116, 117 lateral displacement. In some embodiments, one or both of counter-torque extensions 116, 117 may be laterally displaced so long as both extensions 116, 117 are able to generate sufficient counter torque. For example, the extension angle 122 of counter-torque extension 116 may have a greater angle than the extension angle 123 of counter-torque extension 117. Extension angles 122, 123 may range from 0-1.5 degrees in some implementations.

In some embodiments, only one of counter-torque extensions 116, 117 has a lateral displacement (i.e., extension angle is equal to zero) whereas the other extension is laterally displaced (e.g., positive or negative extension angle). In some implementations, extension angles 122, 123 may be relatively small due to the fact that any overlap of the counter-torque extensions 116, 117 may generate some amount of counter torque.

Moreover, counter-torque extensions 116, 117 may extend from the handles of each member 101, 102. However, in some embodiments, counter-torque extensions 116, 117 extend from other portions (or components) of the left and right member 101, 102 in a transverse direction therefrom.

Figure 4C:
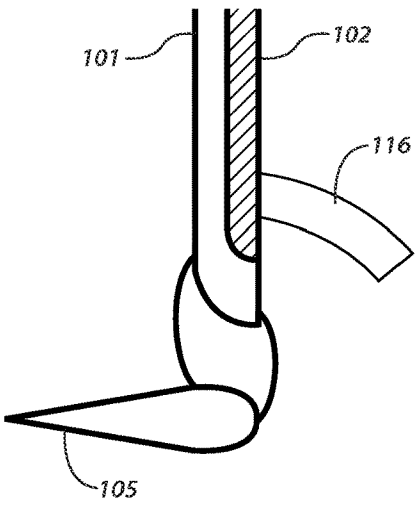
FIGS. 4A-4C illustrate members of the hand-held shearing device in the transition from an open position to a closed position.
Figure 4B:
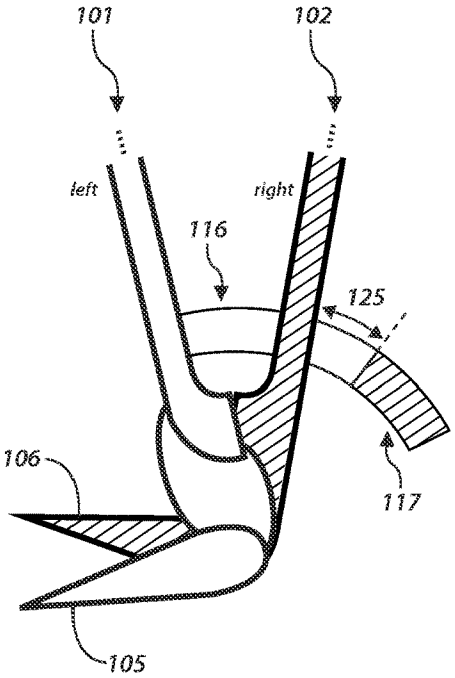
Figure 4A:
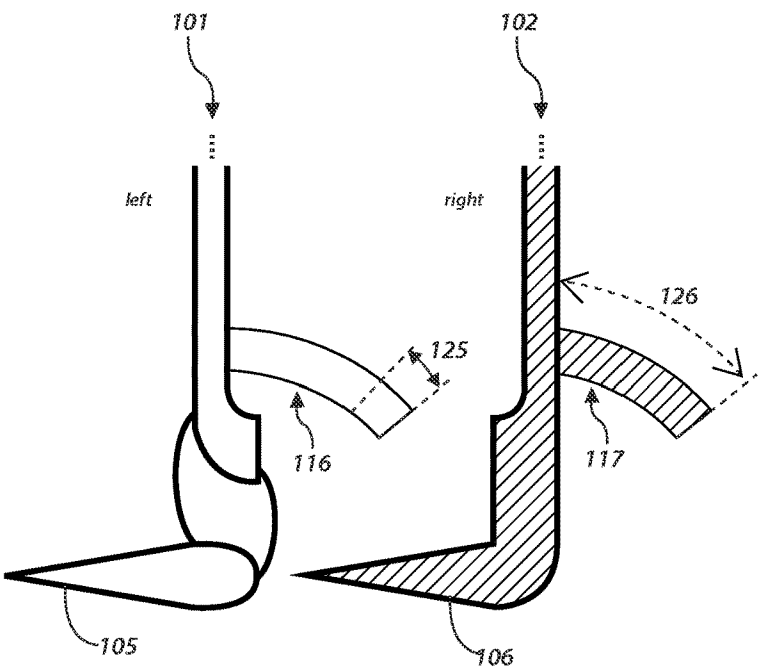

FIGS. 4A-4C illustrate members 101, 102 of hand-held shearing device in the transition from an open position to a closed position. It should be understood by one having ordinary skill in the art that when the hand-held shearing device is engaged in a cutting action, members 101, 102 transition from an open to a closed position.

In FIG. 4A, counter-torque extensions 116, 117 and protrusions 105, 106 of each member 101, 102 are exposed. As described in FIG. 3, the engage and extension lengths 125, 126 of the counter-torque extensions are also shown in the figure. FIG. 4B illustrates members 101, 102 in the transition from an open position to a closed position. During this transition, protrusions 105, 106 become closer aligned to effect a cutting action of a shearable medium.

Most notably, counter-torque extension 116 traverses through a cavity 118 (see FIG. 3A) within member 102 and becomes more aligned with counter-torque extension 117 such that from a side profile, the portion of the counter-torque extension 116 that has traversed through the member's 102 cavity 118 shadows this extension 117. In the embodiment shown, both counter-torque extensions 116, 117 have an arc-shape such that when the hand-held shearing device transitions to a closed position, the extensions are parallel and adjacent to each other along arcs of a circle about the fulcrum (not shown).

FIG. 4C illustrates a hand-held shearing device in a closed position. In the embodiment shown, when the hand-held shearing device reaches the closed position, counter-torque extension 116 completely shadows counter-torque extension 117 from a side-view perspective. In addition, both members 101, 102 are adjacent to each other which may be representative of the two respective handles (not shown) being adjacent to each other when the hand-held shearing device is closed.

Figure 5:
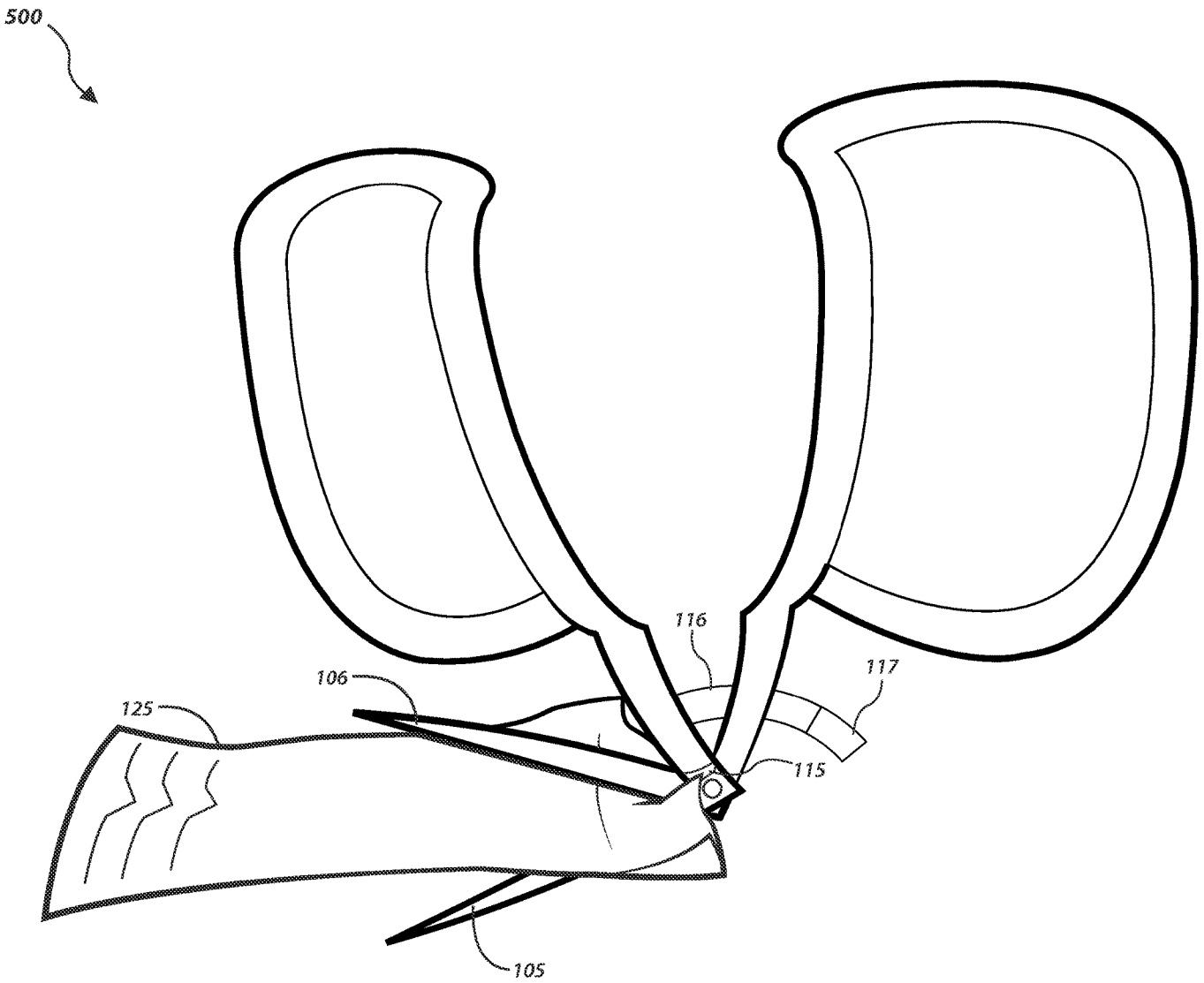
FIG. 5 illustrates a perspective view of a hand-held shearing device consistent with the present disclosure in the process of cutting a shearable medium.

FIG. 5 illustrates a perspective view of a hand-held shearing device 500, having a channel 115, in the process of cutting a shearable medium 125. In the example shown, shearable medium 125 is paper but the present disclosure is not limited thereto. Notably, channel 115 allows shearable medium 125 to pass freely past member 101 while being cut. It should be noted that in preferred embodiments, channel 115 is disposed above the fulcrum 110. However, in some embodiments, channel 115 is located below fulcrum 110.

In some implementations, hand-held shearing device 500 may be adapted to accommodate left or right handedness or implement ergonomic features known in the art. In addition, the blades 105, 106 of hand-held shearing device 500 may be positioned further from the handles, while maintaining the basic design disclosed herein, to reduce the risk of an accident caused by the blades 105, 106. For example, the position of the blades 105, 106 can be adjusted for leverage and the length of the blades 105, 106 may be increased or decreased, either symmetrically or asymmetrically, without departing from the spirit and scope of the present disclosure.

Figure 6B:
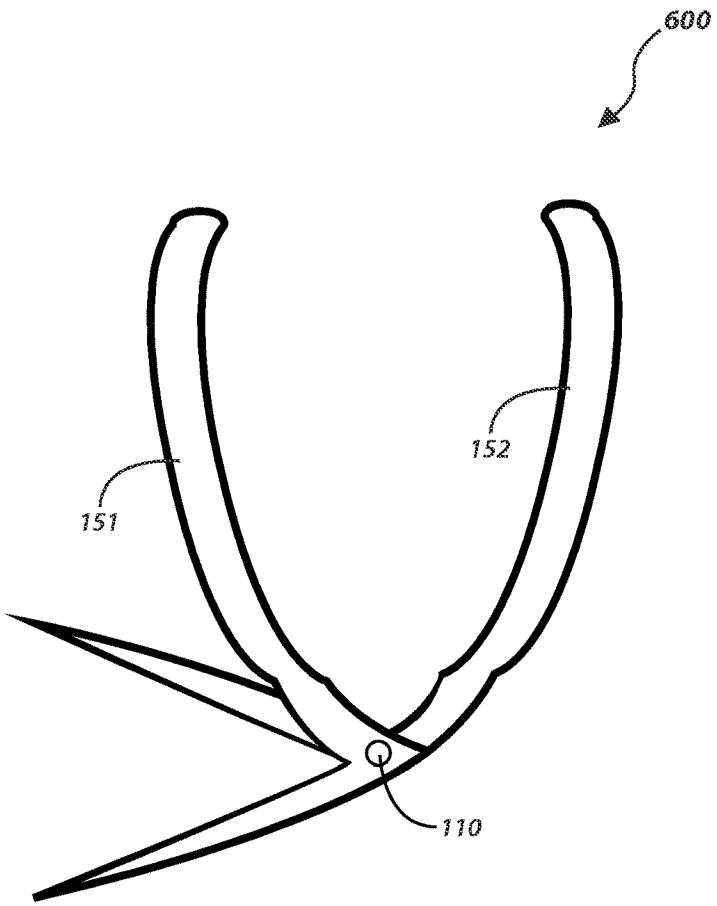
FIG. 6B is a perspective view of the hand-held shearing device from FIG. 6A.
Figure 6A:
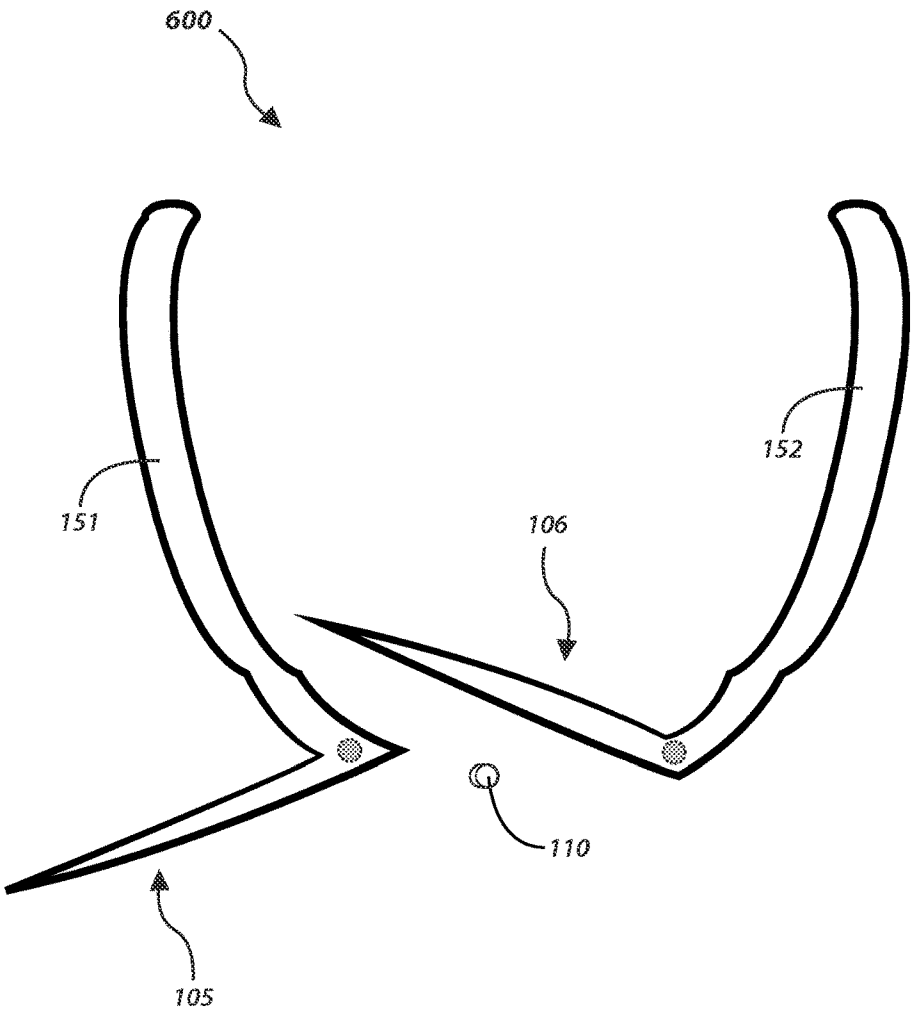
FIG. 6A is an exploded view of another hand-held shearing device consistent with the present disclosure.

FIG. 6A is an exploded view of another hand-held shearing device 600 consistent with the present disclosure. Two members 151, 152 of hand-held shearing device 600 have a substantially "L" shape such that the handle portions are approximately 90 degrees from the blade portions. When assembled, the members 151, 152 are coupled together via a fulcrum 110 which need not be a separate component nor a permanent attachment of members 151, 152. FIG. 6B is a perspective view of the hand-held shearing device 600 from FIG. 6A. Hand-held shearing device 600 may be handled by grasping the sides of the handles with one's fingers, thumb, and/or palm heel. In some embodiments, the blades of hand-held shearing device 600 may be replaced with grasping components such that the device functions or may be incorporated into a pair of graspers, pliers, or spreaders. In addition, hand-held shearing device 600 may include counter-torque extensions 116, 117 (along with a cavity 118 in one of the members 151, 152) to enhance the shearing effect of the blades 105, 106.

Figure 7B:
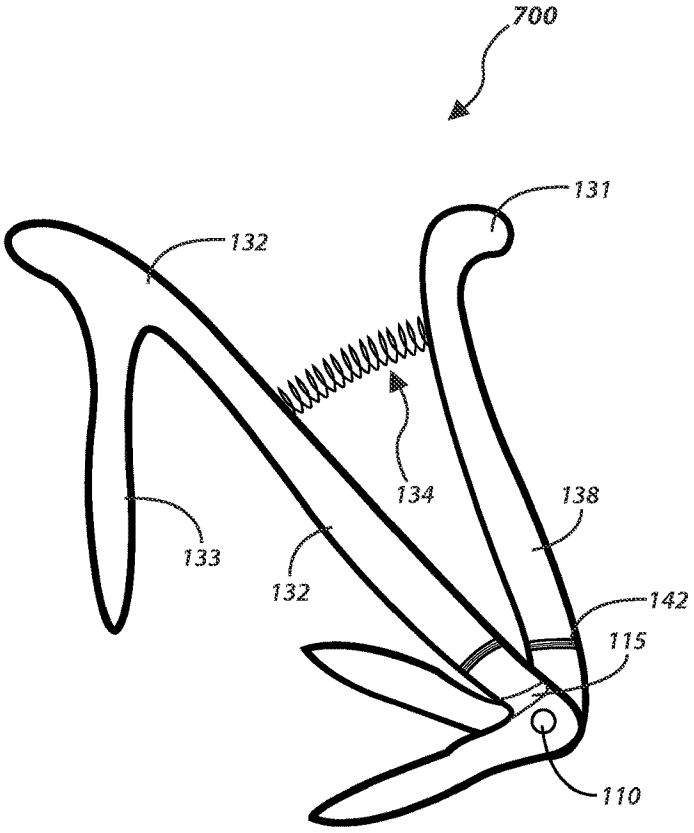
FIG. 7B is a perspective view of the hand-held shearing device from FIG. 7A.
Figure 7A:
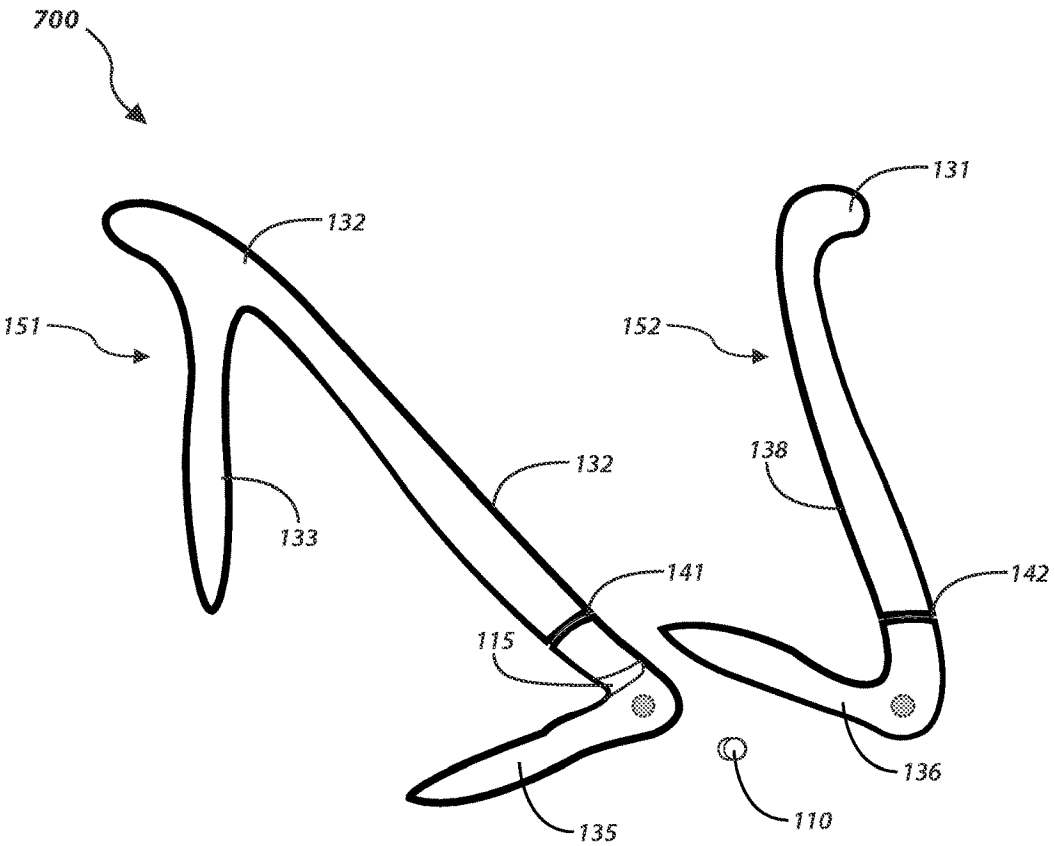
FIG. 7A is an exploded view of yet another hand-held shearing device consistent with the present disclosure.

FIG. 7A is an exploded view of yet another hand-held shearing device 700 consistent with the present disclosure. As shown, hand-held shearing device 700 may comprise first and second members 151, 152 which when assembled are coupled together via pivot point 110. The first and second members 151, 152 may each include shafts 132, 138 from which handles 131, 133 and blades 135, 136 extend therefrom on opposing ends. Notably, handle 133 has a greater length than that of handle 131. In addition, hand-held shearing device 700 may include counter-torque extensions 116, 117 extending from the shafts 132, 138.

Advantageously, the dimensions of handle 133 accommodate the placement of a user's fingers thereon to facilitate finger control of the hand-held shearing device 700. Likewise, the dimensions of handle 131 accommodate the placement of a user's thumb thereon to facilitate finger control of the hand-held shearing device 700.

FIG. 7B is a perspective view of the hand-held shearing device 700 from FIG. 7A. In addition to the components described above, the hand-held shearing device 700 may include a compressive resistance element such as a spring 134 disposed between first and second members 151, 152. In addition, a channel 115 may be readily added to the hand-held shearing device 600 in a manner consistent with the present disclosure.

Although the hand-held shearing device 700 is directed to shearing and cutting applications, the hand-held shearing device 700 may be adapted to plying or prying applications by replacing the blades 105, 106 with suitable protrusions to accomplish such task. As such, the shaft components 132, 138 of the first and second members 151, 152 may have threaded regions 141, 142 (or other mechanical coupling means) such that various endpoints, adaptable for various applications, may be attached to the shafts 132, 138.

This disclosure pertains to a hand-held shearing device and in particular to an inverted hand-held shearing device for various cutting applications. It will be understood by those having ordinary skill in the art that the present disclosure may be embodied in other specific forms without departing from the spirit and scope of the disclosure disclosed. In addition, the examples and embodiments described herein are in all respects illustrative and not restrictive. Those skilled in the art of the present disclosure will recognize that other embodiments using the concepts described herein are also possible.

The invention claimed is:

1. A single-handed hand-held device, comprising:

a first member and a second member coupled together by a pivot point such that each member can rotate independently;

wherein the pivot point is located to facilitate an opening and a closing of the single-handed hand-held device during a cutting action;

a handle on a first region of each member;

wherein the first handle has a first eye-hole and the second handle has a second eye-hole; such that the first handle can facilitate a thumb insertion and the second handle can facilitate the insertion of at least two fingers of the human hand; and an extension on a second region of each member;

wherein the handle and cutting edge of the extension of the first member are disposed approximately 90 degrees apart and the handle and cutting edge of the extension of the second member are also disposed approximately 90 degrees apart;

wherein the handles and cutting edges of the extensions form an angle that is approximately 90 degrees throughout a cutting action;

wherein the inner surface of the second handle which is in contact with the at least two fingers of the hand during the cutting action is disposed in the formed angle whereas the inner surface of the first handle which is in contact with the thumb of the hand during the cutting action is disposed outside of the formed angle;

wherein the shape of each handle and the angular distance between the cutting edges of the extensions and the handles facilitate an upright grip of the hand-held device;

wherein the upright grip is characterized as when a user grips the handles during a cutting action, the extensions are disposed below the handles.

2. The hand-held device of claim 1 further comprising a counter-torque extension which extends in a transverse direction from each member wherein the counter-torque extensions touch when the device is engaged.

3. The hand-held device of claim 1, wherein the counter-torque extensions have an arc-shape.

4. The hand-held device of claim 3, wherein the counter-torque extensions have an angular distance of 45 degrees about the pivot point.

5. The hand-held device of claim 1, wherein the handle of the first member includes a cavity disposed therein to allow the counter-torque extension, which extends from the handle of the second member, to traverse at least partially there through.

6. The hand-held device of claim 1 further comprising a channel disposed on one of the members which allows a portion of a shearable medium to traverse there through during a cutting action.

7. The single-handed hand-held device of claim 1, wherein the extensions are at least one of a pair of blades, prongs, or needles.

8. The single-handed hand-held device of claim 1, wherein the device is at least one of a pair of cutters, clippers, graspers, pliers, spreaders, or scissors.

9. The single-handed hand-held device of claim 1, wherein each handle has an eye-ring shape.

10. The single-handed hand-held device of claim 1, wherein the handle which extends from the first member includes a thumb groove and a palm heel groove and the handle which extends from the second member includes finger grooves.

11. The single-handed hand-held device of claim 1, wherein in response to erecting the hand-held device in an upright position, a grip location area is further from the fulcrum as a result of the configuration of the hand-held device.

12. The single-handed hand-held device of claim 1, wherein in response to erecting the hand-held device in an upright position, a plane of a material being cut neither intersects a location of a grip nor a hand which holds the grip.

13. The single-handed hand-held device of claim 1, wherein both the first member and the second member have an L-shape.

14. A single-handed hand-held shearing device, comprising:

a first member and a second member coupled together by a pivot point such that each member can rotate independently;

wherein the pivot point is located to facilitate an opening and a closing of the single-handed hand-held device during a cutting action;

a handle on a first region of each member;

wherein the first handle has a first eye-hole and the second handle has a second eye-hole; such that the first handle can facilitate a thumb insertion and the second handle can facilitate the insertion of at least two fingers of the human hand; and an extension on a second region of each member;

wherein the handles and cutting edges of the extensions form an angle that is approximately 90 degrees throughout a cutting action such that the first member and the second member are disposed about the pivot point such that two approximately perpendicular axes which form an angle of approximately 90 degrees at an intersection point are disposed such that a first axis of the two approximately perpendicular axes extends between and approximately equidistant from the handles of the first member and the second member and a second axis of the two approximately perpendicular axes extends between and approximately equidistant from the cutting edges of the extensions of the first member and the second member;

wherein the inner surface of the second handle which is in contact with the at least two fingers of the hand during the cutting action is disposed in the formed angle whereas the inner surface of the first handle which is in contact with the thumb of the hand during the cutting action is disposed outside of the formed angle.

15. The single-handed hand-held shearing device of claim 14, wherein the shape of each handle and the angular distance between the cutting edges of the extensions and the handles facilitate an upright grip of the hand-held device;

wherein the upright grip is characterized as when a user grips the handles during a cutting action, the extensions are disposed below the handles.

16. The single-handed hand-held shearing device of claim 14, wherein the intersection point is at the location of the pivot point.

* * * * *